US010967218B2

(12) United States Patent
Murrell et al.

(10) Patent No.: US 10,967,218 B2
(45) Date of Patent: Apr. 6, 2021

(54) SPRING RELEASE FOR EXERCISE RACK ACCESSORY MOUNT

(71) Applicant: Arsenal Strength LLC, Knoxville, TN (US)

(72) Inventors: Jason Murrell, Knoxville, TN (US); Bryan Schmidt, Greenback, TN (US); Steve Schmidt, Greenback, TN (US)

(73) Assignee: Arsenal Strength LLC, Knoxville, TN (US)

( * ) Notice: Subject to any disclaimer, the term of this patent is extended or adjusted under 35 U.S.C. 154(b) by 18 days.

(21) Appl. No.: 16/449,793

(22) Filed: Jun. 24, 2019

(65) Prior Publication Data

US 2019/0308061 A1 Oct. 10, 2019

Related U.S. Application Data

(63) Continuation-in-part of application No. 15/615,919, filed on Jun. 7, 2017, now Pat. No. 10,426,993.

(51) Int. Cl.

| | |
|---|---|
| ***A63B 21/00*** | (2006.01) |
| *A63B 21/078* | (2006.01) |
| *A63B 21/062* | (2006.01) |

(52) U.S. Cl.

CPC ..... *A63B 21/4035* (2015.10); *A63B 21/0626* (2015.10); *A63B 21/0783* (2015.10)

(58) Field of Classification Search

CPC . A63B 17/00; A63B 21/0626; A63B 21/0783; A63B 21/4035; A63B 23/1218; A63B 17/0054; A63B 1/005

See application file for complete search history.

(56) References Cited

U.S. PATENT DOCUMENTS

| | | | |
|---|---|---|---|
| 1,422,128 | A | 7/1922 | Rager |
| 4,286,782 | A | 9/1981 | Fuhrhop |
| 4,492,375 | A | 1/1985 | Connelly |
| D416,471 | S | 11/1999 | Wurdack |
| 6,422,523 | B1 | 7/2002 | Weshler |

(Continued)

OTHER PUBLICATIONS

TuffStuff Fitness International Inc. product catalog.

(Continued)

*Primary Examiner* — Megan Anderson
(74) *Attorney, Agent, or Firm* — Chambliss, Bahner & Stophel, P.C.; Stephen D. Adams

(57) ABSTRACT

An apparatus having an accessory carrier that slides along an exercise rack and repositions an accessory through one-handed operation. A stationary handle fixedly mounts to the accessory carrier by first spacers. A moving handle mounts to the accessory carrier by second spacers. Each second spacer includes a barrel having an open end a closed end. A shaft extends through the barrel and the closed end and is mounted to the moving handle. As the moving handle moves to an engaged position, a pin end of the shaft slides out of the open end of the barrel and engages the exercise rack. This engagement prevents relative movement of the accessory carrier with respect to the exercise rack and fixes the accessory carrier at a selected position. A biasing member biases the moving handle to automatically engage the pin end and lock the accessory carrier in place.

17 Claims, 17 Drawing Sheets

(56) References Cited

U.S. PATENT DOCUMENTS

| | | | | |
|---|---|---|---|---|
| 6,551,226 | B1 * | 4/2003 | Webber | F16B 7/105 403/109.3 |
| 7,337,730 | B2 | 3/2008 | Bienick et al. | |
| 7,338,416 | B2 | 3/2008 | Smith | |
| 7,374,516 | B2 | 5/2008 | Lundquist | |
| 8,337,370 | B2 | 12/2012 | Rogers et al. | |
| 8,827,877 | B2 * | 9/2014 | Giannelli | A63B 21/063 482/102 |
| 9,044,643 | B2 | 6/2015 | Staten et al. | |
| 9,101,198 | B2 | 8/2015 | Tseng | |
| 9,656,116 | B2 * | 5/2017 | Giannelli | A63B 21/063 |
| 9,907,991 | B2 * | 3/2018 | Leipheimer | A63B 21/0626 |
| 10,058,728 | B2 | 8/2018 | Kelly | |
| 2007/0155595 | A1 | 7/2007 | Rogers et al. | |
| 2009/0072111 | A1 | 3/2009 | Paine, Jr. | |
| 2012/0289384 | A1 | 11/2012 | Staten et al. | |
| 2014/0200117 | A1 | 7/2014 | Grider | |
| 2015/0083681 | A1 | 3/2015 | Childs | |
| 2018/0200563 | A1 | 7/2018 | Hansen et al. | |

OTHER PUBLICATIONS

TuffStuff Fitness International Inc. PRO-XL Sports Performance Rack Video Brochure screenshot.

Rogue Fitness, Rogue LT-1 50 Cal Trolley & Lever Arm Kit, URL https://www.roguefitness.com/rogue-lt-1-50-cal-trolley-lever-arms-kit, dowload date Aug. 6, 2019.

* cited by examiner

SPRING RELEASE FOR EXERCISE RACK ACCESSORY MOUNT

CROSS-REFERENCE TO RELATED APPLICATIONS

This application is a continuation-in-part of application Ser. No. 15/615,919, filed Jun. 7, 2017, and entitled TRACK-MOUNTED LEVER RELEASE EXERCISE RACK ACCESSORY MOUNT, which is incorporated herein by reference in its entirety.

FIELD

This invention relates to the field of exercise racks. More particularly, this invention relates to a spring release for an accessory mount used for mounting accessories to an exercise rack and for positioning the accessories at selected heights on the exercise rack.

BACKGROUND

In the description that follows, the term "exercise rack" is used broadly to include any sort of structure intended to support exercise weights, including squat racks, press racks, and the like. Certain exercise racks include left and right vertical members with pairs of mounting locations provided along the length of the vertical members for mounting accessories to the vertical members. For example, bar catch accessories for supporting an exercise bar, such as a barbell, provided with or without weights, may be placed onto the exercise rack. The and left and right bar catches are mounted to the vertical members and may be moved to various mounting locations to support the barbell at various heights. The height of the bar may need to be adjusted based on the type of exercise being performed. For example, the exercise bar may be placed at a low position in the rack with respect to the floor surface and used for bench press exercises. At other times, the exercise bar may be placed at a higher position in the rack with respect to the floor surface and used for squats or overhead press exercises. In addition to transitioning from one type of exercise to another, another reason that the bar might be moved from a first vertical position to a second vertical position on the rack is to accommodate multiple users of the rack that are of varying heights. Other accessories, such as safety bars, may also be mounted to the vertical members of the exercise rack. These bars are often used to support a loaded barbell during rest periods, such as between sets, and also to catch the bar in an accidental drop.

One problem with mounting accessories to an exercise rack using the methods described above is that vertically adjusting the accessory is time consuming. Vertically adjusting the accessory often requires that the accessory be disconnected from the vertical members, repositioned, and then reconnected to the vertical members. This can be a difficult and dangerous process, which could result in the accessory being dropped and or damaged in the process. Another problem is that only the bar catches and safety bars can be mounted to the vertical members of the exercise rack, and other accessories cannot typically be mounted to the rack. Thus, the vertical members provided limited utility.

Accordingly, what is needed is an exercise rack and accessory mount that provides for faster and safer vertical adjustment of an accessory on the rack and that allows for greater flexibility in the types of accessories that can be mounted to the rack.

NOTES ON CONSTRUCTION

The use of the terms "a", "an", "the" and similar terms in the context of describing embodiments of the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "connected" and "interconnected", refer to a relationship wherein structures are secured or attached to one another either directly or indirectly through intervening structures, as well as both moveable and rigid attachments or relationships, unless otherwise specified herein or clearly indicated as having a different relationship by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

SUMMARY

The above and other problems are addressed by an exercise rack accessory apparatus having an accessory carrier configured to slide along a portion of an exercise rack and to reposition an accessory mounted to the accessory carrier. The apparatus includes a stationary handle, which is fixedly mounted to the accessory carrier by one or more first spacers, and a moving handle, which is mounted to the accessory carrier by one or more second spacers, and is configured to allow the moving handle to be moved between an engaged position and a disengaged position while the moving handle is located between the stationary handle and the accessory carrier. Each second spacer includes a barrel having an open end mounted to the accessory carrier and an opposing closed end with an opening formed therein. A shaft extends through the barrel, out of the closed end via the opening, and is mounted to the moving handle. A pin end is located on the shaft opposite the end mounted to the moving handle. The pin end is configured to slide at least partially into the barrel via the open end when the moving handle is moved to the disengaged position and at least partially out of the barrel via the open end, through the accessory carrier, and to engage a portion of the exercise rack when the moving handle is moved to the engaged position. Engaging the pin end with the exercise rack prevents relative movement of the accessory carrier with respect to the exercise rack in order to fix the accessory carrier at the selected position on the exercise rack. Lastly, the apparatus include a biasing member that is compressed when the moving handle is moved to the disengaged position. The biasing member biases the moving handle to the engaged position to automatically lock the accessory carrier in place.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

Figure 1:
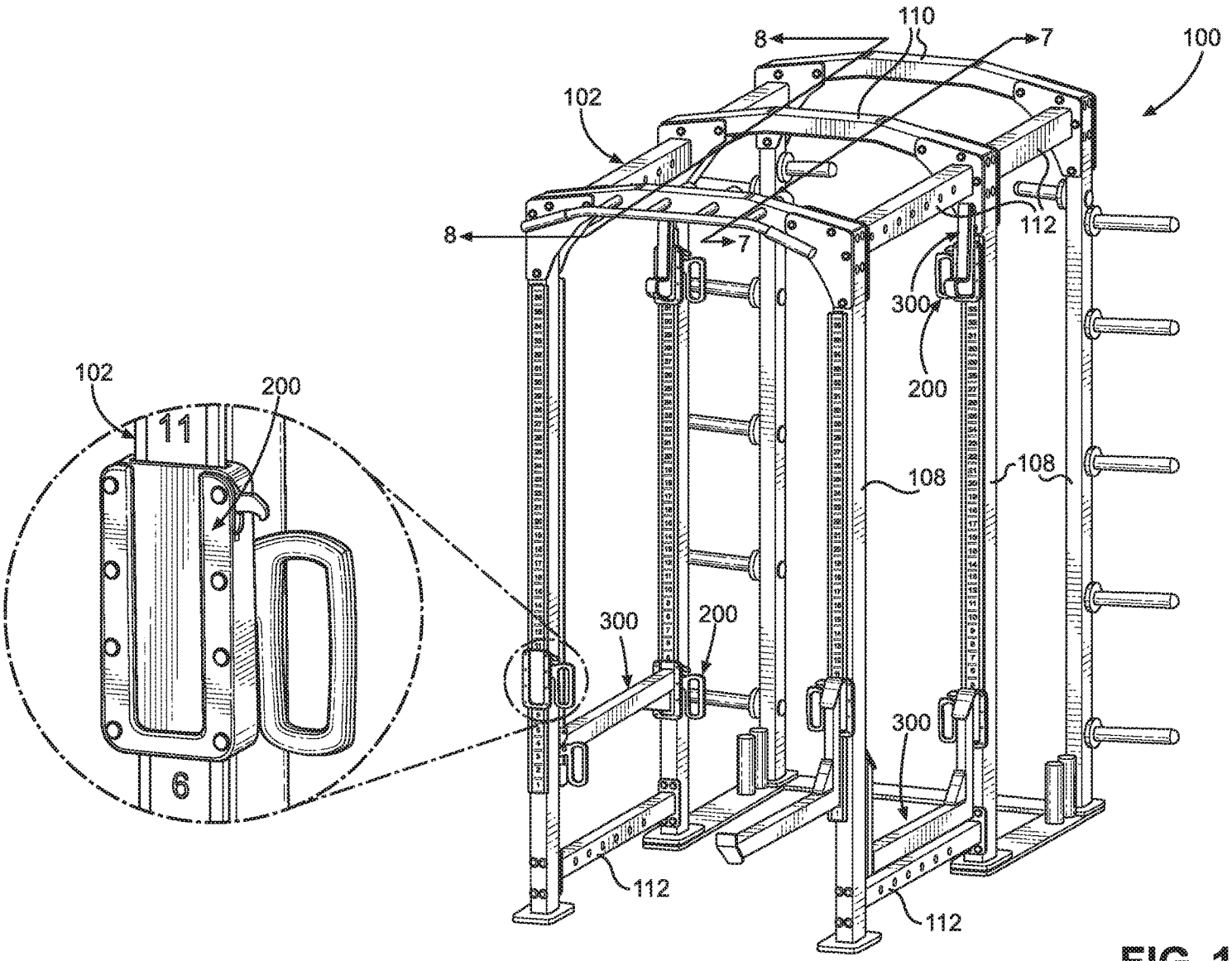
FIG. 1 is a perspective view depicting an exercise rack according to an embodiment of the present disclosure.

Referring now to the drawings in which like reference characters designate like or corresponding characters throughout the several views, there is shown in FIG. 1, an exercise rack and accessory apparatus 100 according to an embodiment of the present disclosure. The apparatus 100 includes generally an exercise rack 102, at least one accessory 300 for an exercise rack, and an accessory carrier 200 mounted to the exercise rack and also mounted to the accessory. The accessory carrier 200 enables accessories 300 to be quickly mounted to and removed from the exercise rack 102.

As it is used in this description, the term "accessory" is used broadly to refer to a device that is mounted to a portion of an exercise rack, including particularly those devices mounted to or between vertical members of the exercise rack, such as J-hooks (i.e., bar catches), safety catches, pull-up bars, and the like.

Figure 3:
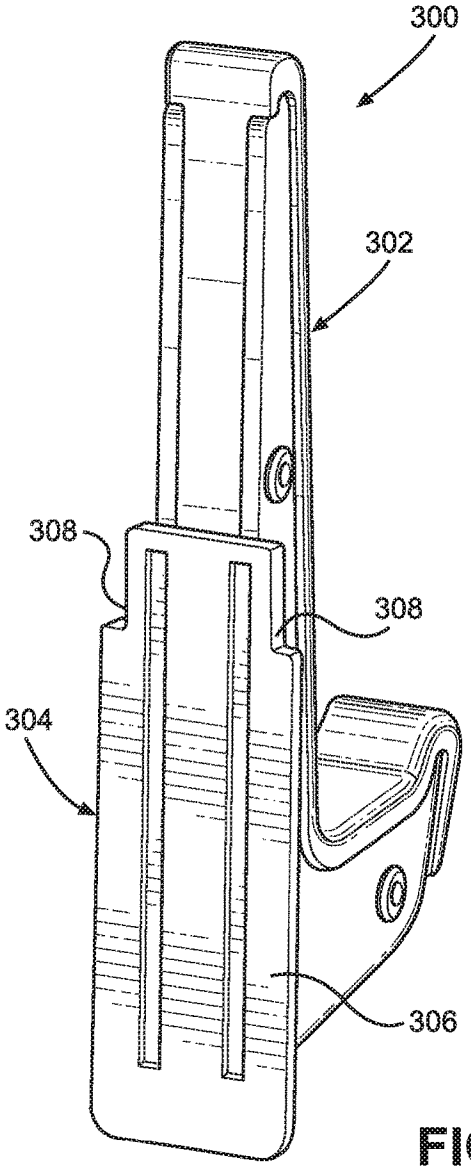
FIGS. 2 and 3 are front and rear perspective views, respectively, of an exercise rack accessory according to an embodiment of the present disclosure.
Figure 2:
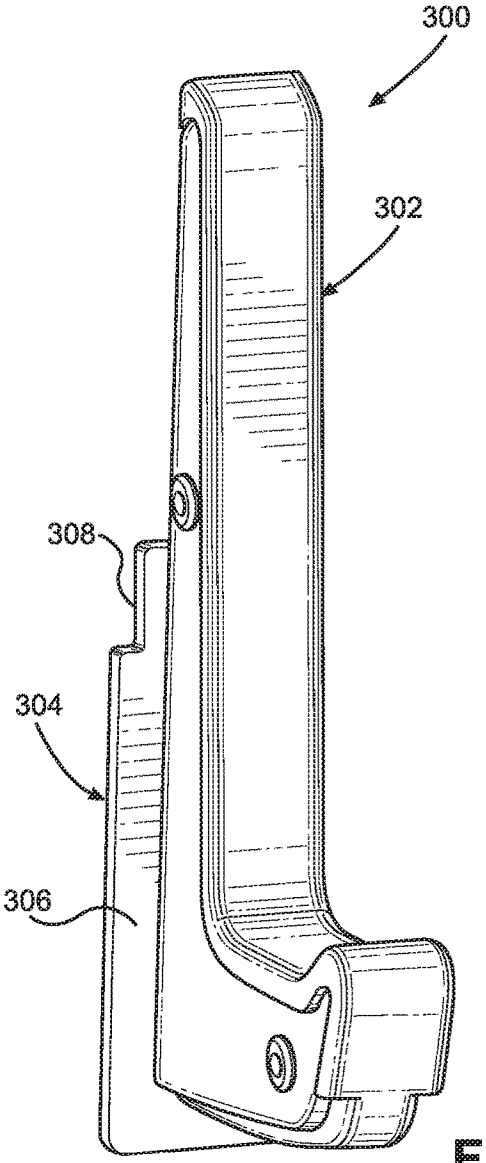

As shown in FIGS. 2 and 3, each of the accessories 300 includes use portion 302 of the accessory. Typically, the use portion 302 is where the user or weights contact the accessory. For example, in the case of a safety bar accessory, a barbell may be placed directly onto the use portion 302. In the case of a pullup accessory, the user may grasp the use portion to perform the exercise. Each accessory has at least one mounting plate 304 that is fixedly mounted to the use portion 302. The mounting plate 304 includes a lip portion 306 that extends outwards away from the use portion 302. In this particular case, the lip portion 306 extends outwards from the left and right sides and the bottom of the use portion 302. As discussed further below, the lip portion 306 of the accessory 300 is configured to slide into a slot formed in the accessory carrier 200 to removably mount the accessory within the accessory carrier. In certain cases, the mounting plate 304 may be provided with one or more notches 308 formed in a top surface of the lip portion 306. As discussed further below, the notches 308 interact a locking mechanism, which prevents the accessory 300 from being lifted out of the accessory carrier 200 accidentally.

Figure 4:
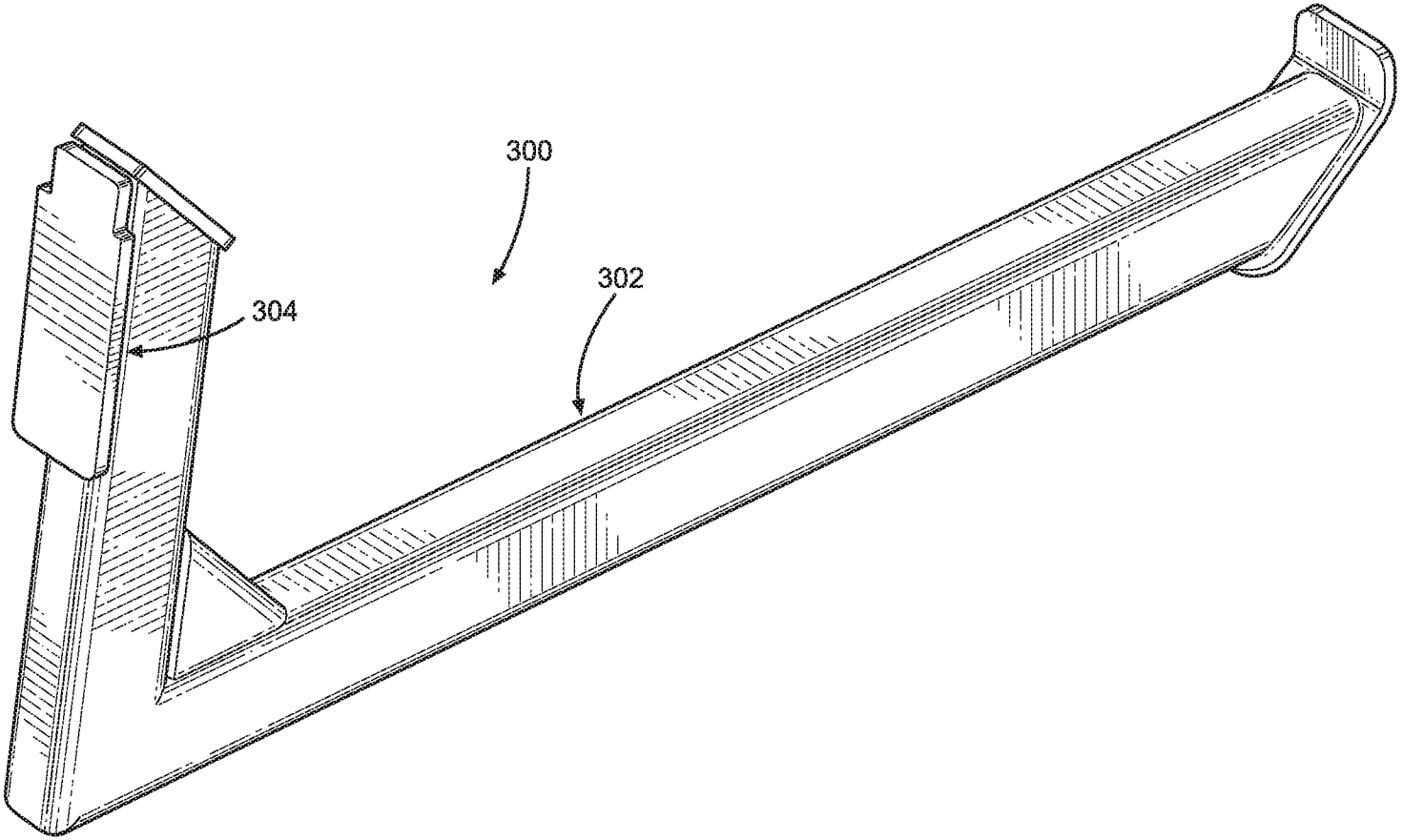
FIGS. 4-6 depict alternative exercise rack accessories according to various embodiments of the present disclosure.

The accessories shown in FIGS. 2 and 3 are often referred to as J-hooks or bar catches. They are typically mounted to a front face of left and right sides of an exercise rack and support a portion of an exercise bar (e.g., barbell). Other types of accessories may be mounted to the exercise rack 102 using the presently-described apparatus. For example, FIG. 4 provides a safety catch use portion 302 that may be mounted, on only one end, to a vertical member of an exercise rack via a mounting plate 304.

Figure 5:
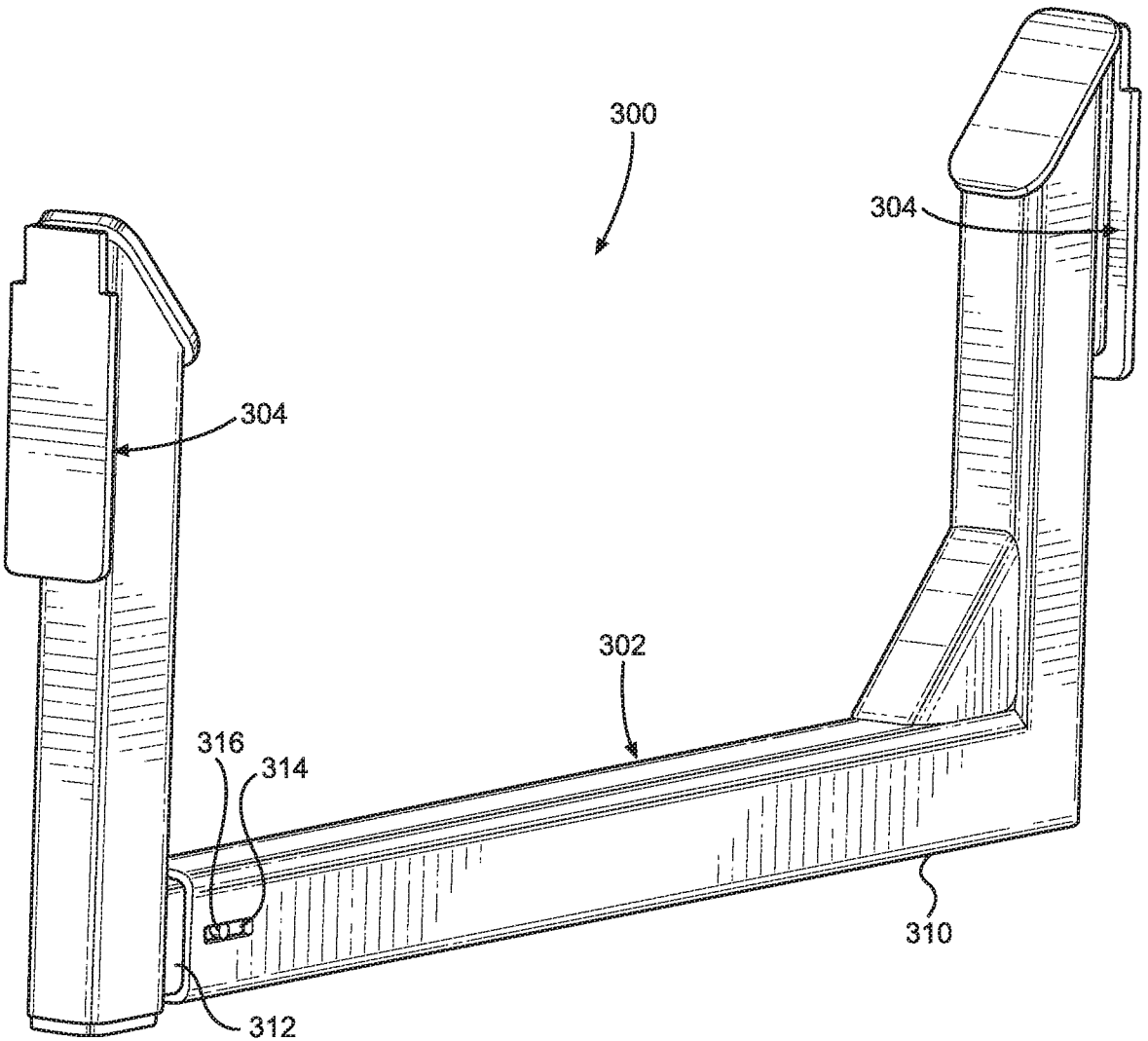
Figure 6:
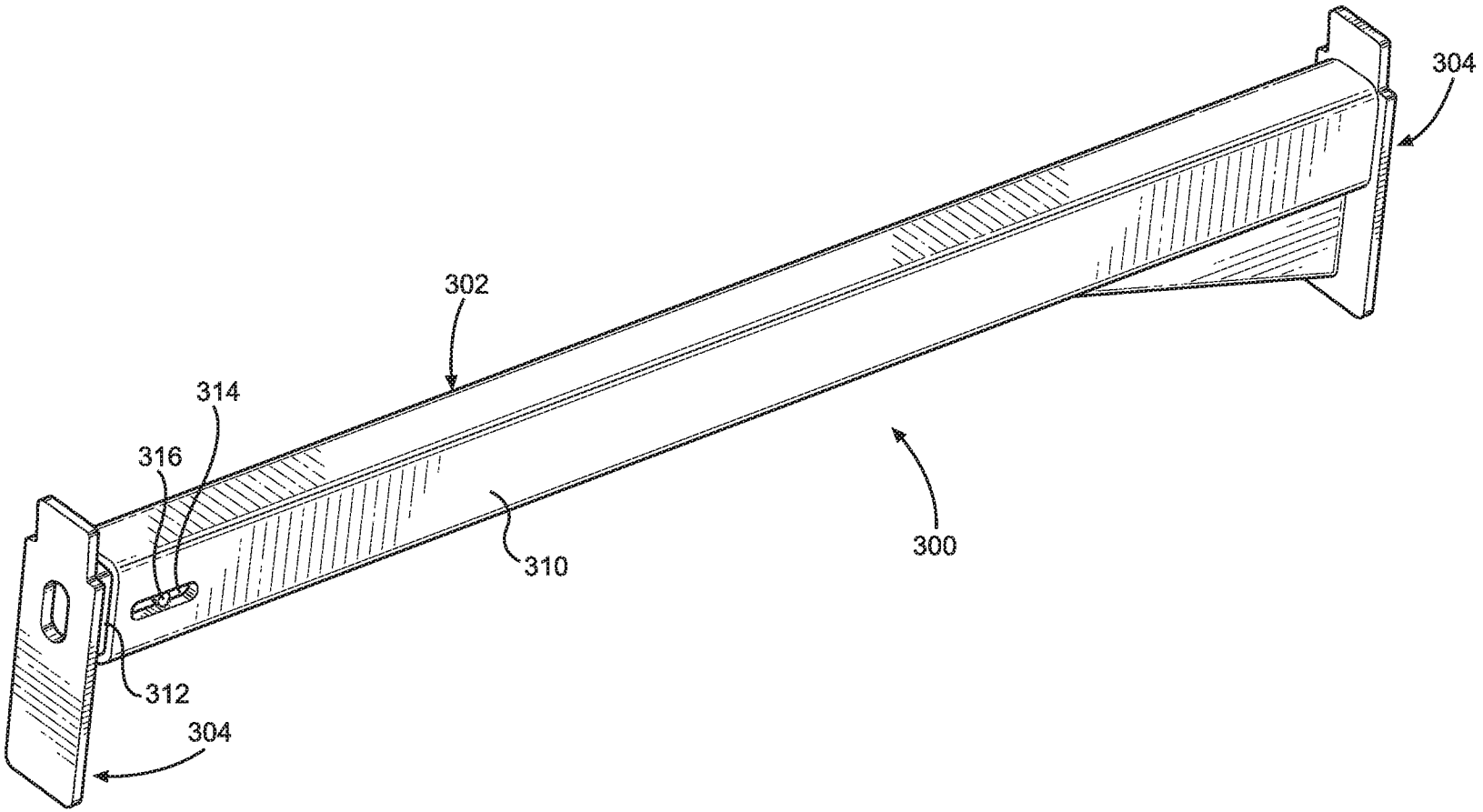

On the other hand, FIGS. 5 and 6 provide two safety catch accessories 300 that may be mounted between two vertical members of an exercise rack. These accessories 300 might be useful, for example, as safety catches to prevent an exercise bar from hitting the floor. Accordingly, these accessories 300 include mounting plates 304 located at opposing ends of the use portion 302 that support the accessory between vertical members of an exercise rack.

These accessories 300 are adjustable in length. This adjustability enables the accessories 300 to fit between vertical members that are spaced at varying distances apart. The adjustability also simplifies the installation process by allowing the accessories to be shortened while being placed between the vertical members and then extended to mount the mounting plates 304 to the exercise rack. The use portion 302 of these accessories 300 includes a first horizontal member 310 having a hollow interior and that is open on one end. A second horizontal member 312 is configured to slide into the hollow interior of the first horizontal member 310 via the open end. The size of the accessory 300 may be increased or decreased by sliding the second horizontal member 312 out of or into the first horizontal member 310. The amount of relative member between the horizontal members 310, 312 may be limited by engaging a first limiting member 314 with a second limiting member 316. In this particular case, the first limiting member 314 is an elongate slot formed into the first horizontal member 310. The second limiting member 316 is a detent extending outwards from the second horizontal member 312 that is configured to slide within the slot (i.e., first limiting member) 314.

Figure 7:
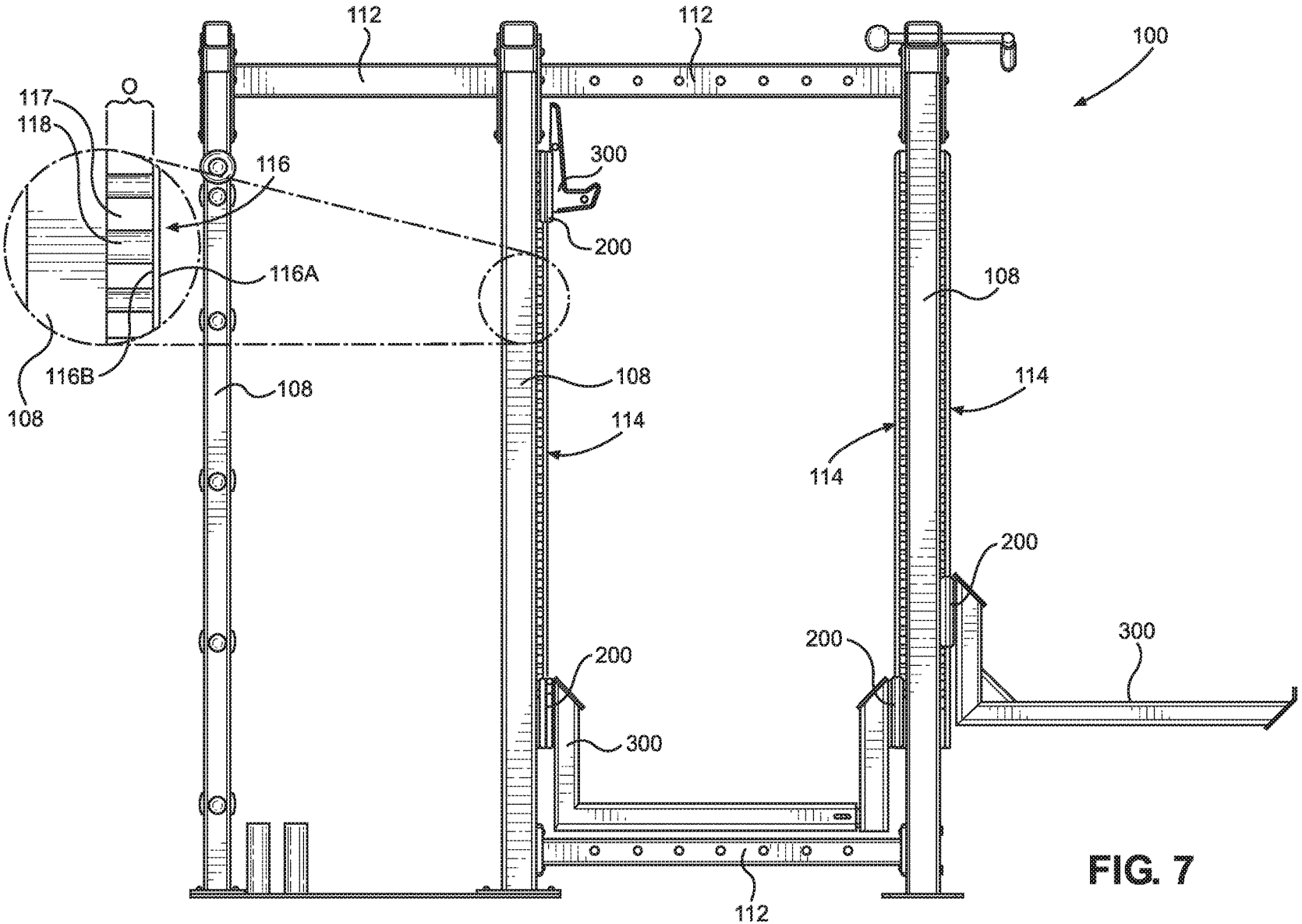
FIG. 7 is a plan view of the exercise rack of FIG. 1 shown along section line 7-7.
Figure 8:
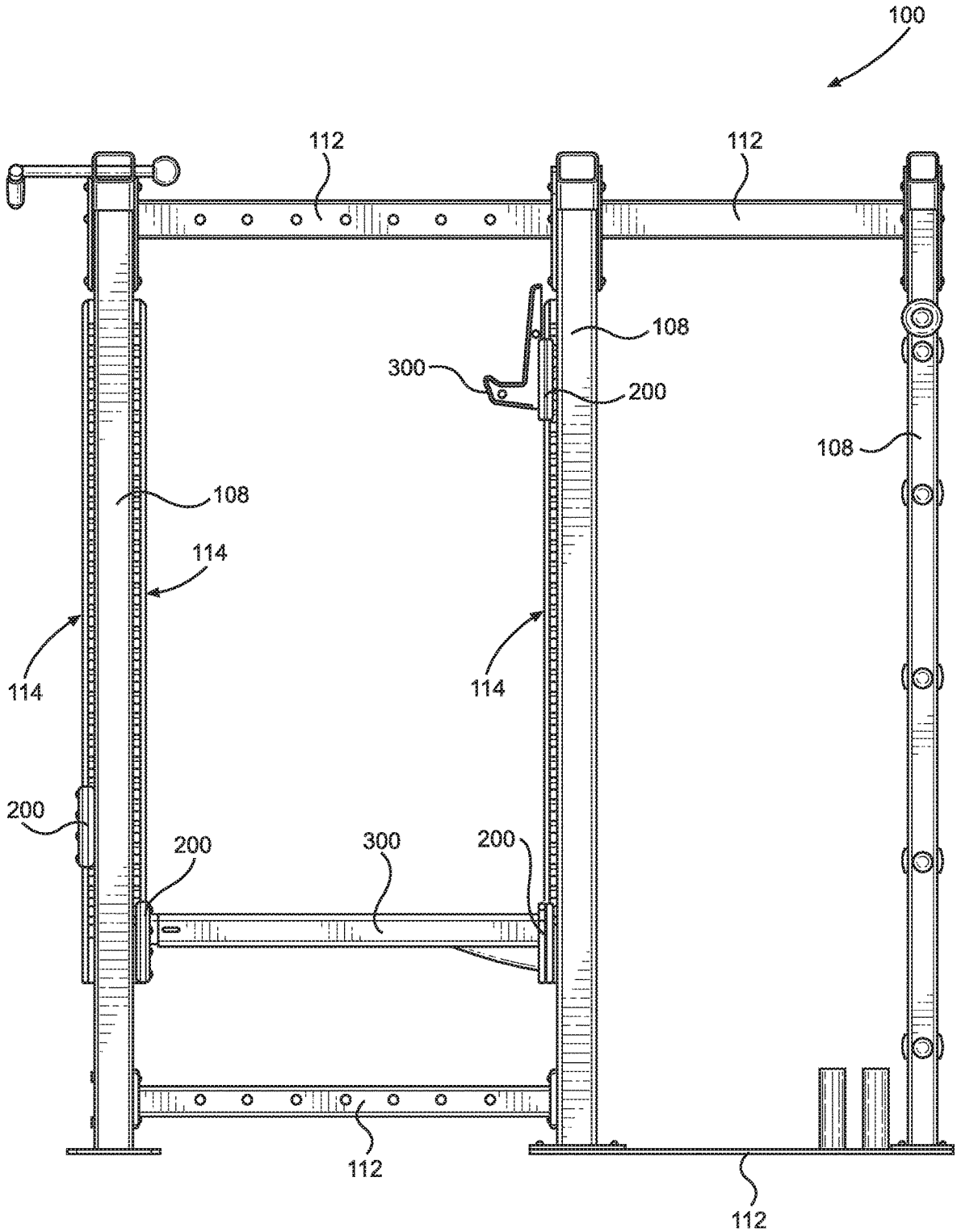
FIG. 8 is a plan view of the exercise rack of FIG. 1 shown along section line 8-8.
Figure 9:
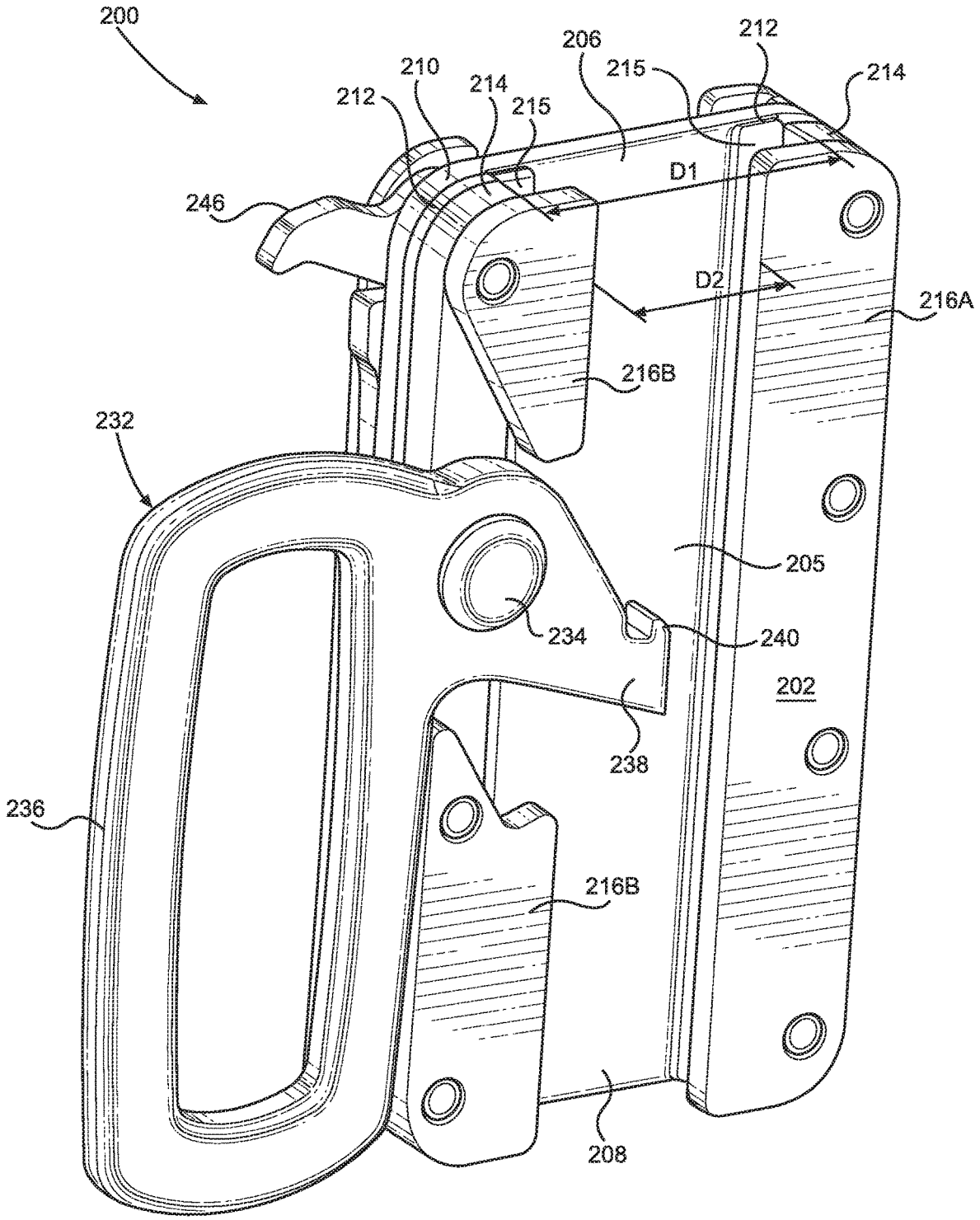
FIG. 9 is a front perspective view of an accessory carrier according to an embodiment of the present disclosure.
Figure 10:
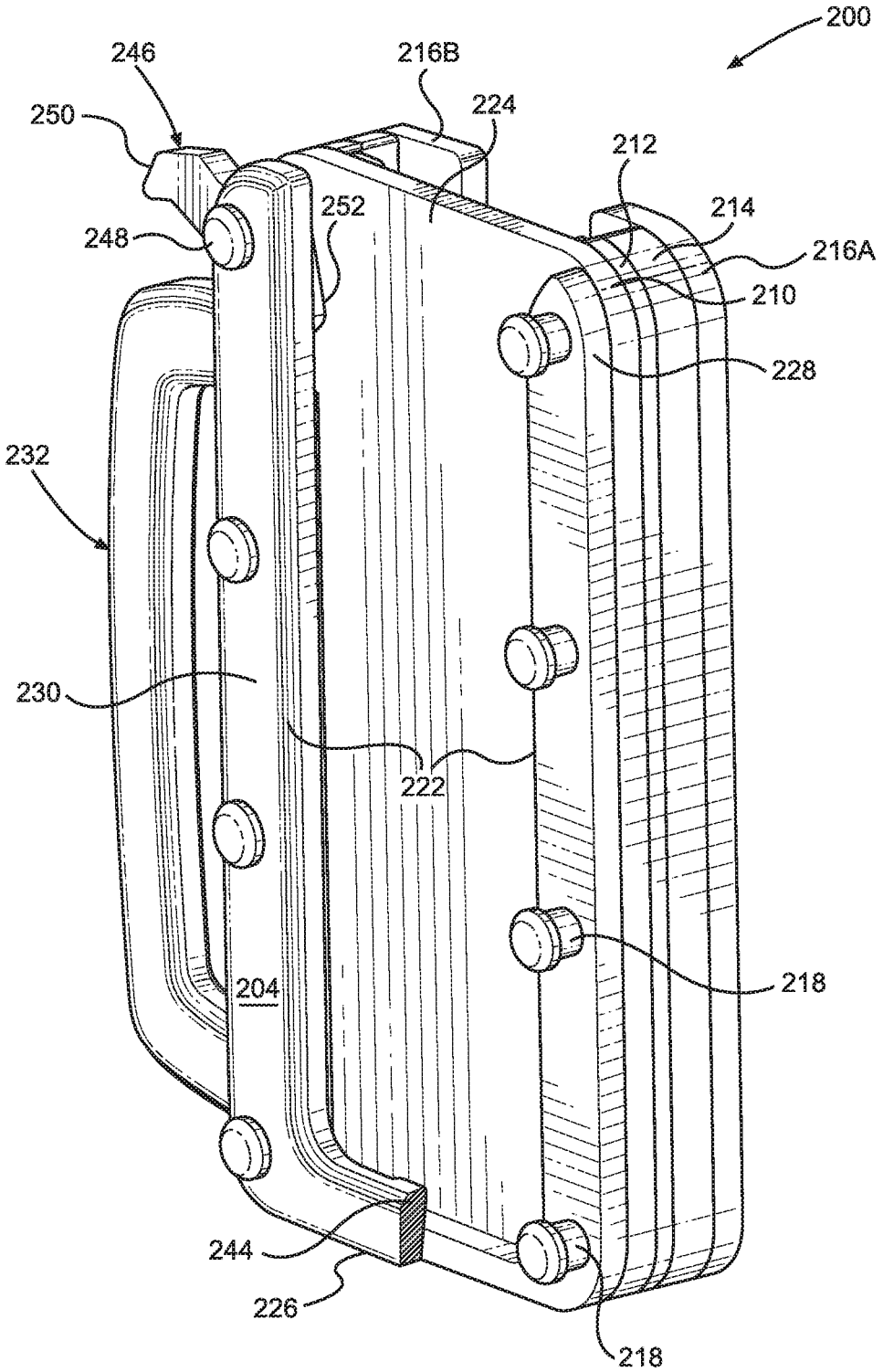
FIG. 10 is a rear perspective view of an accessory carrier according to an embodiment of the present disclosure.
Figure 11:
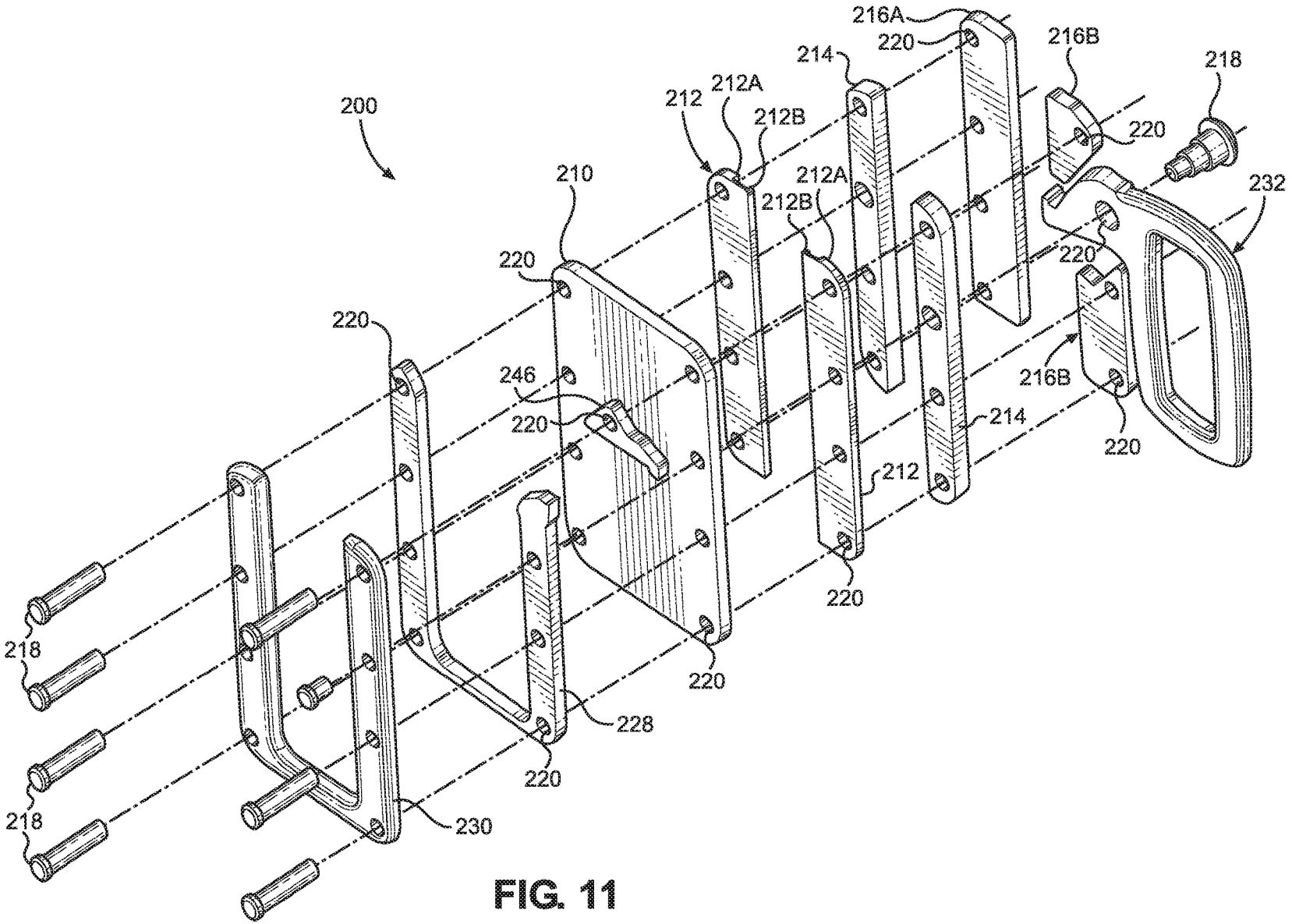
FIG. 11 is a front exploded view of the accessory carrier shown in FIG. 4.

The accessories 300 described above are shown mounted to an exercise rack 102 in FIG. 1 and FIGS. 7 and 8. At a minimum, an exercise rack 102 should include at least two vertical rack members 108 that are arranged and configured such that an exercise bar (e.g., a weighted barbell) may be placed between them and ends of the bar are supported by the accessories 300 mounted to the vertical rack members. In this particular case, a full cage is provided with a total of six vertical rack members 108, which are arranged into three sets of aligned pairs that are connected together by lateral (e.g., side-to-side) connectors 110. Top ends of the pairs of vertical rack members 108 are connected together by longitudinal (e.g., front-to-back) connectors 112. Additionally, bottom ends of the rack members 108 may also be connected by additional longitudinal connectors 112.

Tracks 114 are mounted to multiple of the vertical rack members 108. The tracks 114 are typically arranged in pairs, with one track disposed on a right side of the rack 102 and a corresponding track located on a left side of the rack. This configuration enables an elongate weight bar, such as a barbell, to be supported at opposite ends by accessories 300, such as J-hooks or safety bars, mounted to tracks 114. Generally, these tracks 114 are mounted to front and back surfaces of the vertical rack members 108. This allows opposite ends of exercise bars to be supported by the exercise rack 102 such that the accessory extends between two adjacent vertical rack members 108. However, a single track 114 (i.e., not a pair) may be mounted the exercise rack 102. Also, tracks 114 may be mounted to surfaces other than the front and back of the vertical rack members 108 (e.g., sides of the vertical members). Each track 114 includes an elongate rectangular bar-shaped carrier guide 116. The carrier guide 116 is mounted to the vertical rack members 108 and serves as an interface that connects the accessory carrier 200 to the exercise rack 102. Each track 114 also includes a retention bar 117, which includes a plurality of spaced apart notches 118 formed therein, that extends vertically and substantially along the length of the track. As discussed below, the accessory carrier 200 is fixed at a selected vertical location by engaging it with the notches 118 of the retention bar 117. An offset O is provided between the carrier guide 116 and the vertical rack member 108 by mounting the retention bar 117 between the carrier guide and the vertical member. This offset O allows the accessory carrier 200 to contact a front surface 116A and a rear surface 116B of the carrier guide in order to securely mount the accessory carrier to the track 114. Accordingly, the accessory carrier 200 serves a dual purpose of mounting an accessory to the exercise rack 102 and also vertically positioning the accessory on the exercise rack.

With reference to FIGS. 9-12, the accessory carrier 200 has a first side 202 that is mounted to the exercise rack 102 and a second side 204 that may be removably mounted to an accessory 300. The accessory carrier 200 is formed by several layers that are stacked together as a single unit. A rectangular central plate 210 divides the first side 202 from the second side 204. The central plate 210 has vertically-oriented mounting holes 220 disposed along its left and right sides. Each of the other layers discussed below also include mounting holes 220 that correspond to one or more of the mounting holes in the central plate 210. The layers are connected together by connectors 218 (e.g., threaded connectors, rivets, etc.) that pass through the mounting holes 220 and fixed therein. Once mounted together, the above-described components form a channel 205 on the first side of the accessory carrier 200. The channel 205 has an open upper end 206 and open lower end 208 that is configured to engage and to slide vertically along the carrier guide 116 of the track 114. Similarly, a slot 222 having an open upper end 224 and enclosed lower end 226 is formed on the second side 204 of the accessory carrier 200. The mounting plate 304 of the accessory 300 slides into the slot 222 and is retained there in order to removably mount the accessory to the accessory carrier 200.

On the first side 202, elongate bar-shaped first spacers 212 extend along each of the left and right sides of the central plate 210 on either side of the channel 205. The first spacers 212 are divided vertically lengthwise, having a thick outer portion 212A, including mounting holes 220, on one side of the divide and a comparatively thinner inner portion 212B on the opposite side of the divide. The first spacers 212 are spaced apart from one another and arranged so that the inner portions 212B are nearest the center of the central plate 210. The outer portions 212A are along the outer left and right edges of the central plate 210 such that the mounting holes 220 of each is aligned. A second set of elongate bar-shaped spacers 214 is mounted to the first set of spacers 212. The second spacers 214 are approximately the same size and dimensions as the outer portion 212A of the first spacers 212. First retainers 216A, 216B are mounted to the second set of spacers 214. The first retainers 216A, 216B are wider than the second spacers 214 such that a portion of the first retainers extend inwards beyond the second spacers. As a result, parallel vertical slots 215 are formed along the left and right sides of the channel 205. On one side of the channel 205, the slot 215 is defined by an elongate bar-shaped first retainer 216A, a second spacer 214, and the inner portion 212B of a first spacer 212. On the opposite side of the channel 205, the other slot 215 is defined by a pair of smaller first retainers 216B, a second spacer 214, and the inner portion 212B of a first spacer 212. As discussed further below, a space is provided between upper and lower first retainers 216B and a carrier lock 232 is mounted in that space.

The accessory carrier 200 is mounted to the track 114 by placing the carrier guide 116 into the channel 205 with left and right edges of the mounting carrier guide located in the left and right slots 215. As such, the first retainers 216A, 216B are sized to fit within the offset O between the carrier guide 116 and the vertical rack member 108. The first retainers 216A, 216B slide along one side of the carrier guide 116 and prevent the accessory carrier 200 from being removed from the carrier guide 116 of the track 114. Likewise, the inner portion 212B of the first spacers 212 slides along the opposite side of the carrier guide 116 and guide carrier guide along the track 114. The channel 205 has a first portion with a width D1 that is formed between inner surfaces of the two second spacers 214. The carrier guide 116 is sized to fit within the space between the two second spacers 214. Therefore, the carrier guide 116 has a width less than D1. Also, the combined thickness of the outer portion 212A of the first spacers 212 and the second spacers 214 is greater than the thickness of the carrier guide 116. As a result, the accessory carrier 200 slides along the track 114 with the carrier guide 116 positioned within the space between the second spacers 214. The channel 205 further includes a second portion with a width D2 that is formed between inner surface of the first retainers 216A, 216B. As mentioned earlier, a primary purpose of the first retainers 216A, 216B is to prevent the accessory carrier 200 from being removed from the carrier guide 116 of the track 114. Accordingly, the carrier guide 116 has a width greater than D2, such that, if pulled away from the track 114, the carrier guide contacts the first retainers 216A, 216B and the accessory carrier 200 maintains its connection with the track.

As mentioned earlier, the retention bar 117 connects the vertical rack member 108 to the carrier guide 116. As such, the first retainers 216A, 216B of the accessory carrier 200 are spaced apart such that the retention bar 117 of the track 114 can extend through that space and mount to the carrier guide 116. Therefore, the retention bar 117 has a width less than D2. When raised or lowered, the accessory carrier 200 slides along the track 114 with the retention bar 117 positioned within the space between the first retainers 216.

Figure 12:
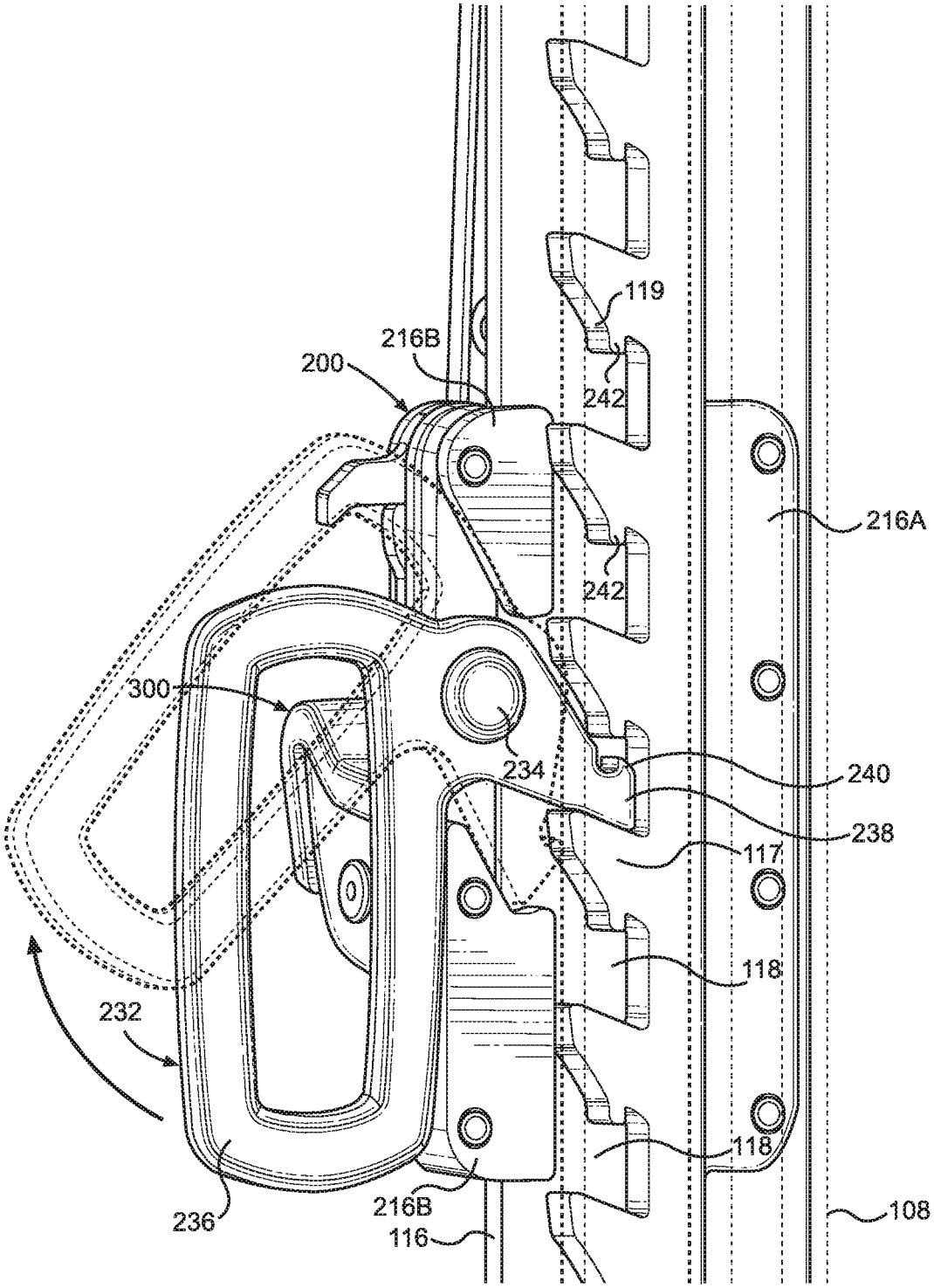
FIG. 12 depicts the accessory carrier shown in FIG. 4 mounted to an exercise rack in a first (i.e., locked) position and in a second (i.e., unlocked) position.
Figure 13A:
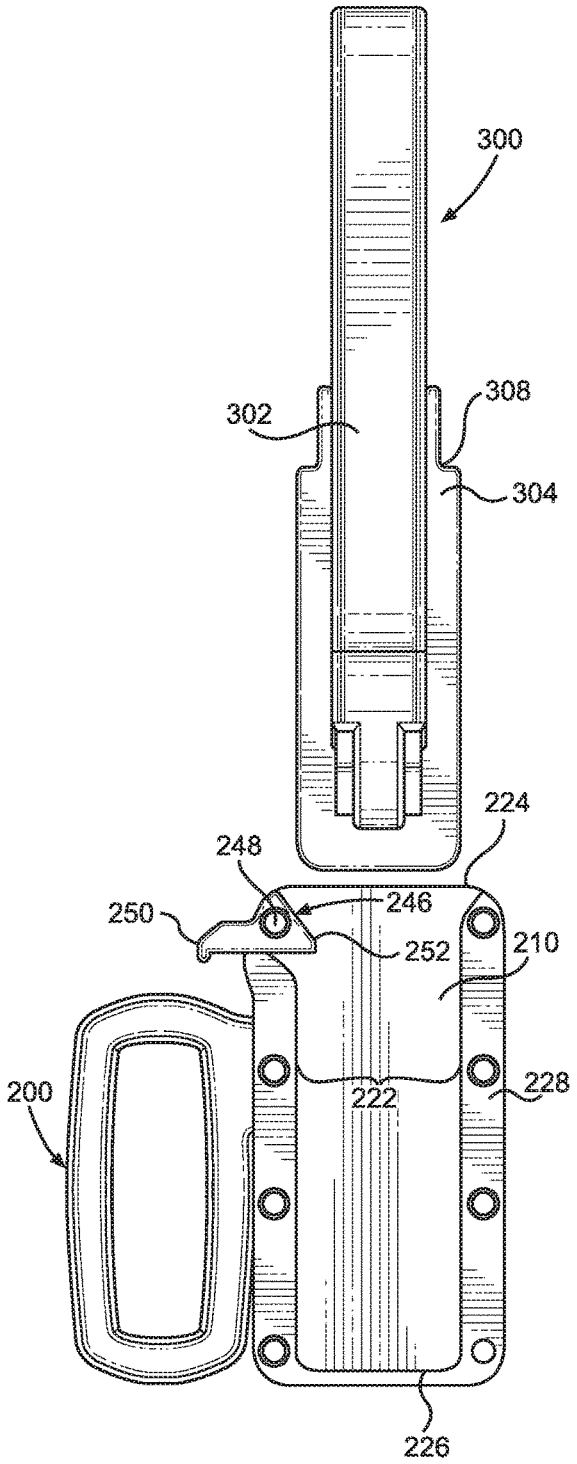
FIGS. 13A-13D depict a sequence for inserting an exercise rack accessory into an accessory carrier according to an embodiment of the present disclosure.
Figure 13B:
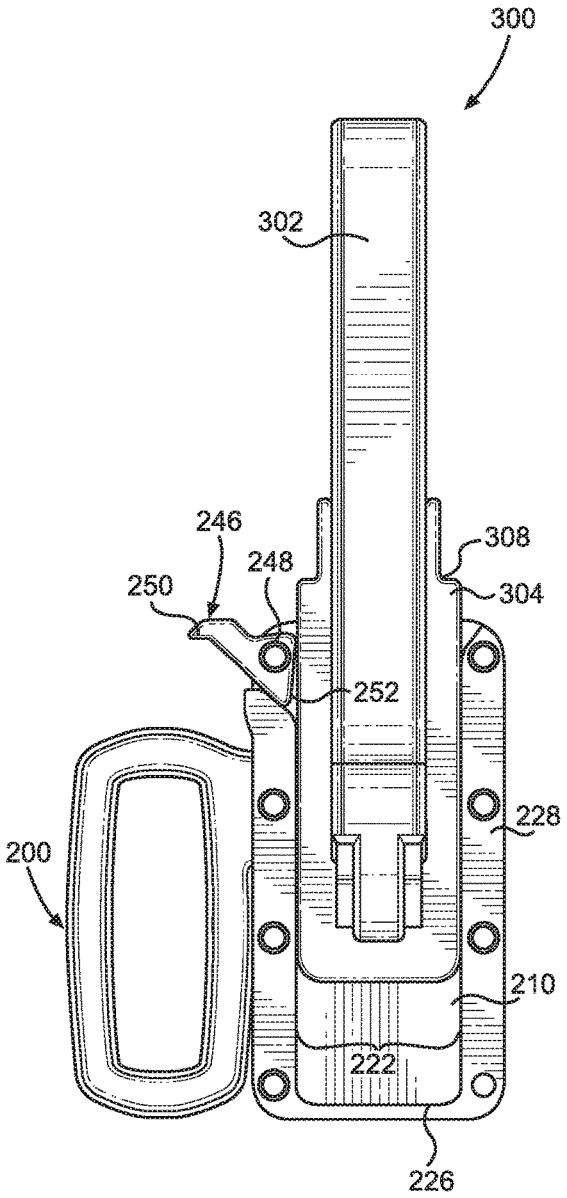
Figure 13C:
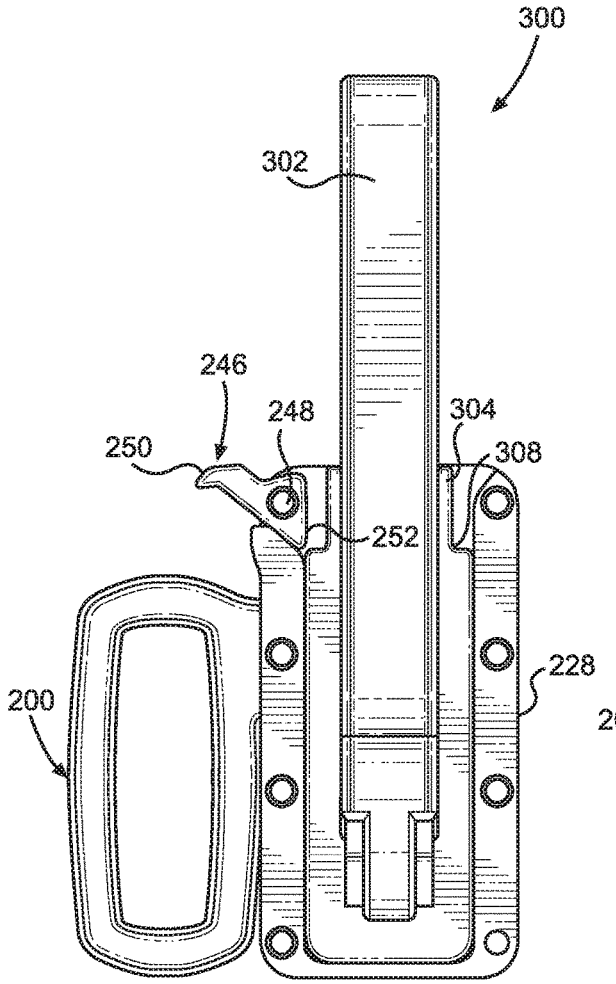
Figure 13D:
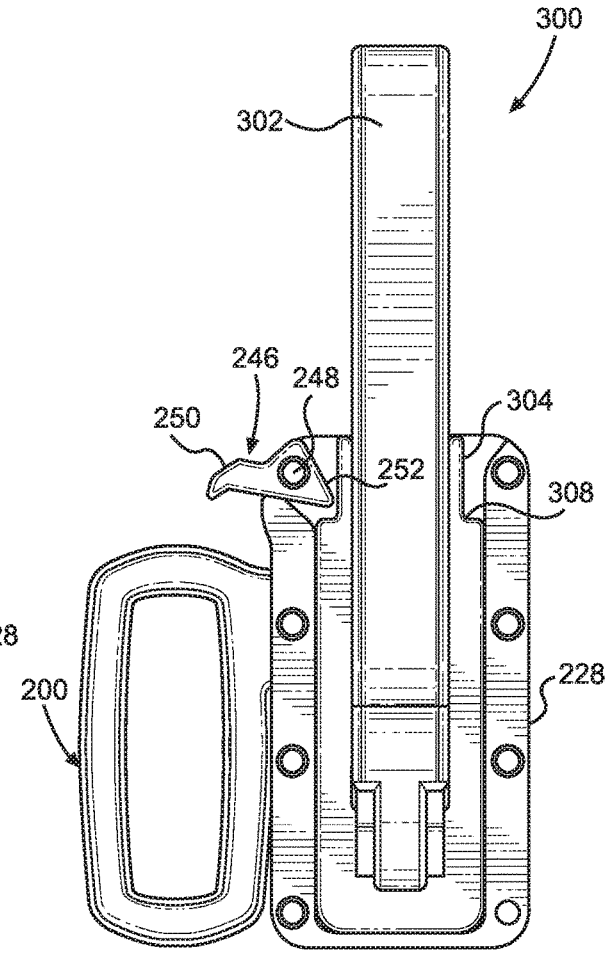

With reference to FIG. 12, when the accessory carrier 200 is positioned at the desired vertical location, the carrier lock 232 is rotated from a second (i.e., unlocked) positioned to a first (i.e., locked) position in order to securely hold the accessory carrier at that vertical position. The carrier lock 232 is pivotally mounted to the accessory carrier at a pivot point 234 located between the upper and lower first retainers 216B. The carrier lock 232 has a handle 236 on one side of the pivot point 234 for rotating the carrier lock about the pivot point and a locking tip 238 on an opposite side of the pivot point for selectively engaging with a notch 118 of the retention bar 117. The carrier lock configured to rotate between a first (i.e., locked) position, where the locking tip 238 is located within a notch 118 of the retention bar 117, and a second (i.e., unlocked) position, where the locking tip is not located within a notch. In the first (i.e., locked) position, the locking tip 238 is configured to contact a portion of a retention bar 117 to prevent the accessory carrier 200 from sliding vertically along the carrier guide 116. In the second (i.e., unlocked) position, the locking tip 238 is removed from within the notches 118 and the accessory carrier 200 can freely slide along the carrier guide 116.

The upper and lower first retainers 216B act as rotation limiting members to limit the degree of rotation that the carrier lock 232 can undergo. When the carrier lock 232 is in first (i.e., locked) position, its rotation is limited by contacting an outer face of the lower first retainer 216B. In the second (i.e., unlocked) position, the carrier lock 232 is prevented from rotating too far by contacting the upper first retainer 216B. The carrier lock 232 may be configured to also an inner face of the lower first retainer 216B.

As a safety feature, the carrier lock 232 may be biased to automatically rotate to the first (i.e., locked) position. In this particular embodiment, the handle 236 is heavier than the locking tip 238, which causes the carrier lock 232 to rotate about the pivot point 234 to the first (i.e., locked) position. In other embodiments, a spring or other similar biasing means may be provided to cause the carrier lock to be automatically rotated to the first (i.e., locked) position. To further assist the carrier lock 232 to be correctly positioned in the first (i.e., locked) position, the retention bar 217 may have contoured front sections 119 located above each of the notches 118 that slope inwards towards the notch 118. As the accessory carrier 200 is lowered, the locking tip 238 is automatically rotated so that it comes into contact and follows along the contoured section 119 and is correctly located within a notch 118. These are safety features that assist in correcting locking the accessory carrier 200 in place and, more importantly, arresting unintentional downwards movement (i.e., drops) of the accessory carrier. Preferably, when the auto-biasing carrier lock 232 is used, sustained downwards movement of the accessary carrier 200 is only possible when the carrier lock is intentionally held by a user in the second (i.e., unlocked) position by a user.

As another safety feature, the carrier lock 232 may be further provided with an upwardly extending tooth 240 that engages with a corresponding downwardly-extending tooth 242 located along a top surface of each of the notches 118 at the lower end of the contoured section 119 when the accessory carrier 200 is raised. When the teeth 240, 242 are engaged with one another, the carrier lock 232 is prevented from rotating from the first (i.e., locked) position to the second (i.e., unlocked) position. To unlock the carrier lock 232, a user is required to lift the accessory carrier 200 and then rotate the carrier lock 232 to the second (i.e., unlocked) position using then handle 236. The purpose of this safety feature is to prevent the carrier lock 232 from accidentally rotating to the second (i.e., unlocked) position and the accessory carrier falling downwards as a result (e.g., if the accessory carrier is bumped or gets caught on the user).

With reference to FIGS. 10 and 11 and FIGS. 13A-13D, the second side 204 includes a U-shaped third spacer 228 that is mounted to the central plate 210. A U-shaped second retainer 230 is then mounted to the third spacer 228. The U-shaped third spacer 228 and the U-shaped second retainer 230 are oriented so that their open ends are located at the top end of the accessory carrier 200. The second retainer 230 is wider than the third spacer 228 and a portion of the second retainer extends further into the slot 222 to form a lip 244 around the bottom and sides of the slot 222. The lip 244 of the slot 222 is configured to engage the lip 306 of the mounting plate 304. To mount an accessory 300 to the accessory carrier 200, the mounting plate 304 slides downwards through the open end of the U-shaped third spacer 228. The bottom of the mounting plate 304 is vertically supported by the inner surface of the third spacer 228 and the lip 306 of the mounting plate 304 is retained by the lip 244 formed by the second retainer 230. Once the accessory 300 is inserted into the accessory carrier 200, the use portion 302 of the accessory extends outwards through the U-shaped second retainer 230 and is available for use. To remove the accessory 300, it is simply lifted upwards out of engagement with the U-shaped third spacer 228 and U-shaped second retainer 230.

As a safety feature, the accessory carrier 200 may include a safety stop 246 for preventing the accessory 300 from accidentally disengaging from the accessory carrier. The safety stop 246 is rotatably mounted to the accessory carrier 200 via pivot point 248 and includes a user contact portion 250 disposed on one side of the pivot point and a locking tip 252 disposed on an opposite side of the pivot point. The safety stop 246 is configured to move between a second (i.e., unlocked) position, where the accessory 300 is permitted to freely slide into and out of the slot 222, and a first (i.e., locked) position, where the accessory is prevented from disengaging from the slot. Preferably, when the accessory 300 contacts the locking tip 252 of the safety stop 246, the safety stop is moved automatically to the second (i.e., unlocked) position. As a result, the accessory 300 is able to freely slide into the slot 222 because the mounting plate 304 automatically moves the safety stop 246 to the second (i.e., unlocked) position as it slides by.

Additionally, the safety stop 246 is preferably biased to the first (i.e., locked) position so that it automatically returns to the first (i.e., locked) position after the mounting plate 304 has been inserted into the slot 222 sufficiently far in order to secure the mounting plate within the slot. In this particular embodiment, the user contact portion 250 is heavier than the locking tip 252, which causes the safety stop 246 to rotate about the pivot 248 to the first (i.e., locked) position. In other embodiments, a spring or other similar biasing means may be provided to cause the safety stop 246 to be automatically rotated to the first (i.e., locked) position.

In the first (i.e., locked) position, the locking tip 252 may simply top surface of the mounting plate 304 of the accessory 300. However, in other embodiments, the mounting plate 304 may be provided with one or more notches 308 formed in a top surface of the lip portion 306, and the locking tip 252 of the safety stop engages the notch in the first (i.e., locked) position. In preferred embodiments, the mounting plate 304 is provided with notches 308 located on both the left and right sides of the top surface of the mounting plate 304. This allows the same accessory 300 to be used interchangeably in accessory carriers 200 with either left or right-located safety stops 246.

Figure 14:
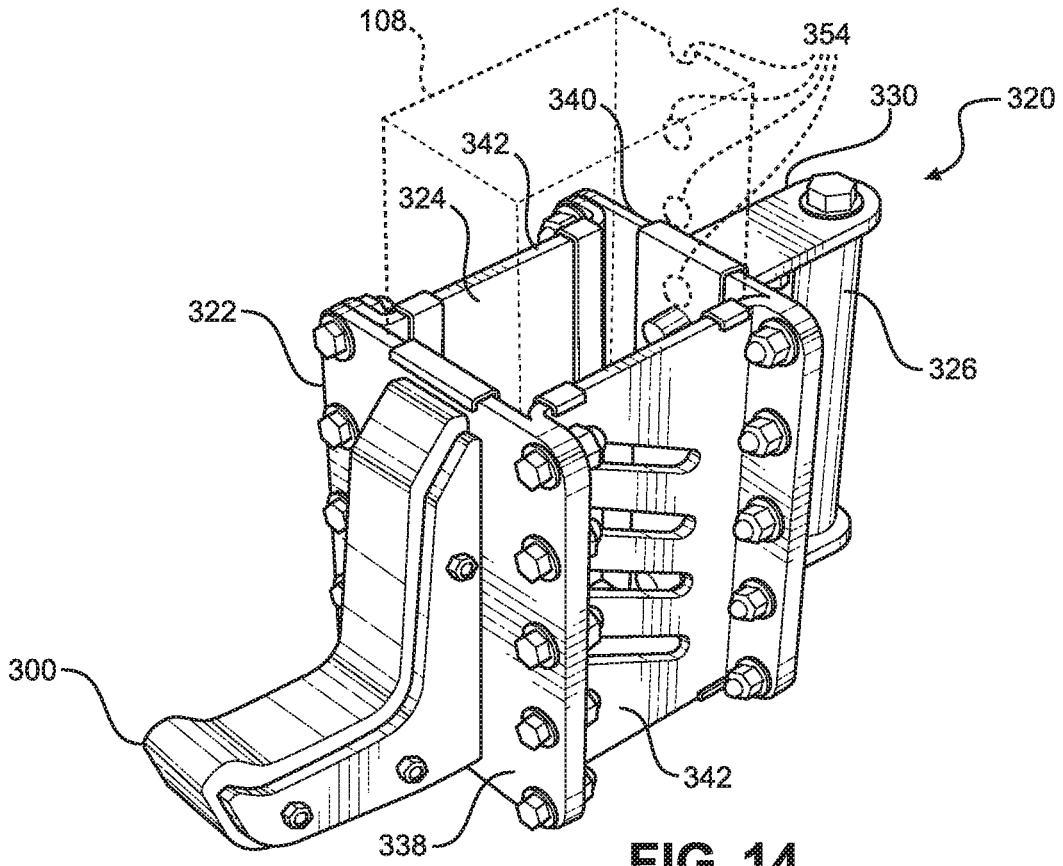
FIG. 14 is a front perspective view of an exercise rack accessory apparatus, including an accessory carrier, according to an alternative embodiment of the present disclosure.
Figure 15:
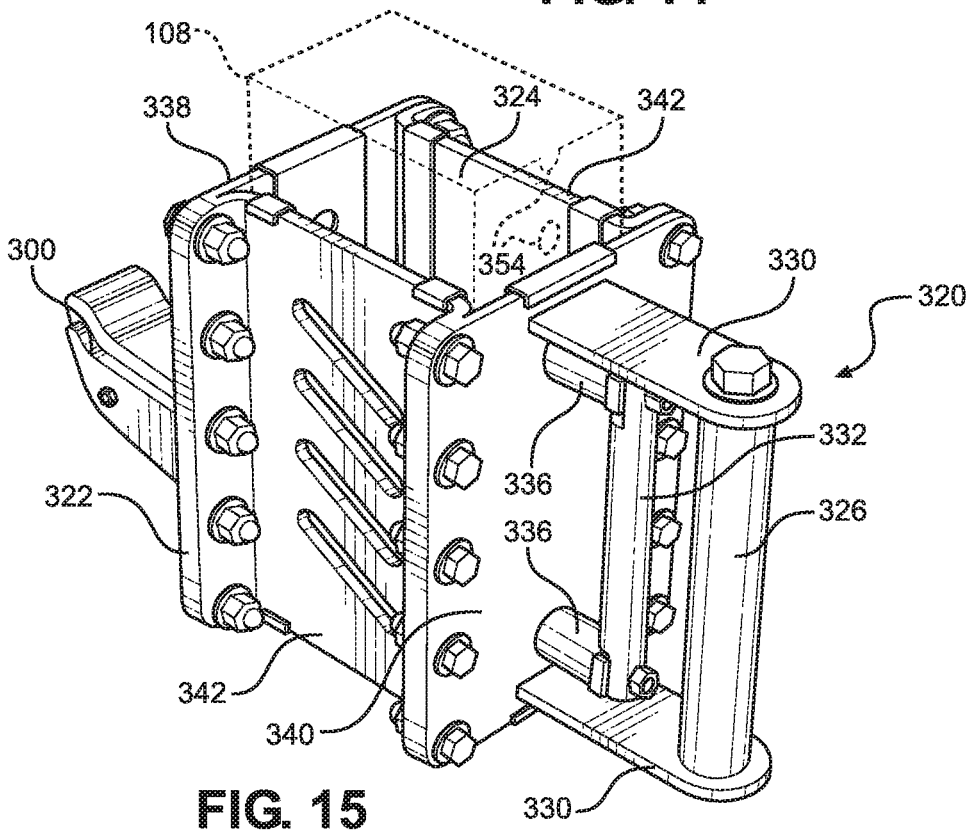
FIG. 15 is a rear perspective view of the apparatus of FIG. 14.
Figure 16:
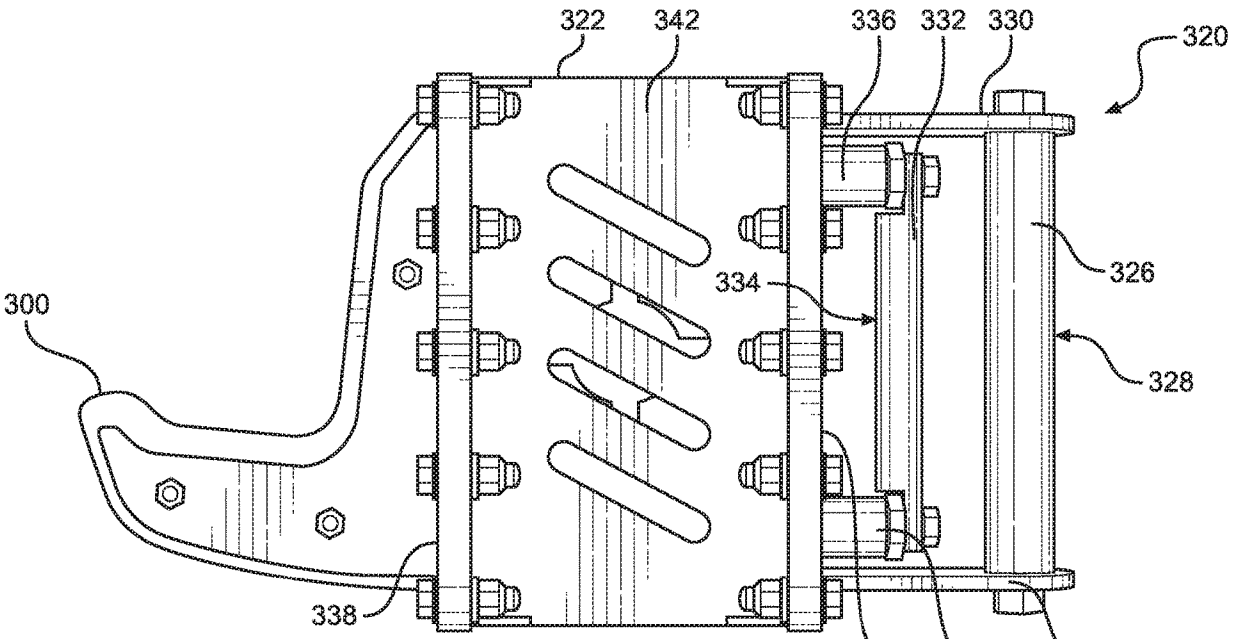
FIG. 16 is a right-side elevation view of the apparatus of FIG. 14.

With reference now to FIGS. 14-16, there is provided an exercise rack accessory apparatus 320 according to an alternative embodiment of the present disclosure. The apparatus 320 includes an accessory carrier 322 having a guide channel 324 that is configured to slide along a portion of an exercise rack, such as vertical rack member 108 (shown in FIG. 8). In this particular embodiment, the accessory carrier 322 is formed by a front plate 338, a rear plate 340, and a pair of side plates 342, which are arranged to form an enclosure and that enclosure serves as the guide channel 324 for receiving the exercise rack. In some embodiments, at least one of the faces of the accessory carrier 322 (i.e., the front plate 338, the rear plate 340, or one of the side plates 342) can be temporarily removed to enable the accessory carrier to be positioned around a portion of the frame of the exercise rack. In this particular case, the faces of the accessory carrier 322 are bolted together and can be easily disconnected from one another by being un-bolted. In other cases, the accessory carrier 322 may have only three enclosed faces (e.g., a front plate 338, a rear plate 340, and a single side plate 342) and an open face to enable the accessory carrier to be placed around the exercise rack via the open face.

An accessory, such as accessory 300, may be fixedly or removably mounted to the accessory carrier 322. The accessory carrier 322 is designed to carry and reposition the accessory 300 on the exercise quickly and without requiring the accessory carrier to be removed from the exercise rack. Preferably, the accessary carrier 322 is designed to allow the accessory to be repositioned using only one hand. The accessary carrier 322 has a pair of handles, including a stationary handle 326 and a moving handle 332. As detailed below, these handles 326, 332 are grasped simultaneously by one of user's hands to both release the accessory carrier from its locked or engaged configuration and to reposition it while in a disengaged position. Releasing the moving handle 332 locks the accessory carrier 322 in place at a selected height. The stationary handle 326 includes a palm contact surface 328 (located on the right-hand side of the stationary handle, as shown in FIG. 16) that is configured to be contacted by the user's palm. The moving handle 332 includes a finger contact surface 334 (located on the left-hand side of the moving handle, as shown in FIG. 16) that is configured to be contacted by the user's fingers when the user's palm is in contact with the palm contact surface 328. Thus, in preferred embodiments, the palm contact surface 328 is angled approximately 180° with respect to the finger contact surface 334. Also, when the user's palm contacts the palm contact surface 328, the user's thumb is preferably located on one side of the stationary handle 326 and the user's fingers are preferably located on an opposite side of the stationary handle.

The stationary handle 326 is fixedly mounted to an outer surface of the accessory carrier 322 by one or more first spacers 330. The moving handle 332 is movably mounted to an outer surface of the accessory carrier by one or more second spacers 336. The stationary handle 326 and the moving handle 332 may each be mounted to the accessary carrier 322 by a single spacer 330, 336. In the illustrated embodiment, both ends of each of the stationary handle 326 and moving handle 332 are mounted to the rear plate 340 of the accessary carrier 322 by spacers 330, 336. Preferably, the stationary handle 326 and first spacers 330 are sized to surround the moving handle 332 and second spacers 336 on three sides (top, bottom and right sides, as shown in FIG. 16) with the accessory carrier 322 being located on the remaining side of the moving handle (the left side, as shown in FIG. 16). As such, the moving handle 326 is positioned between the stationary handle 326 and the accessory carrier 322 to facilitate one-handed use of the pair of handles.

Figure 17:
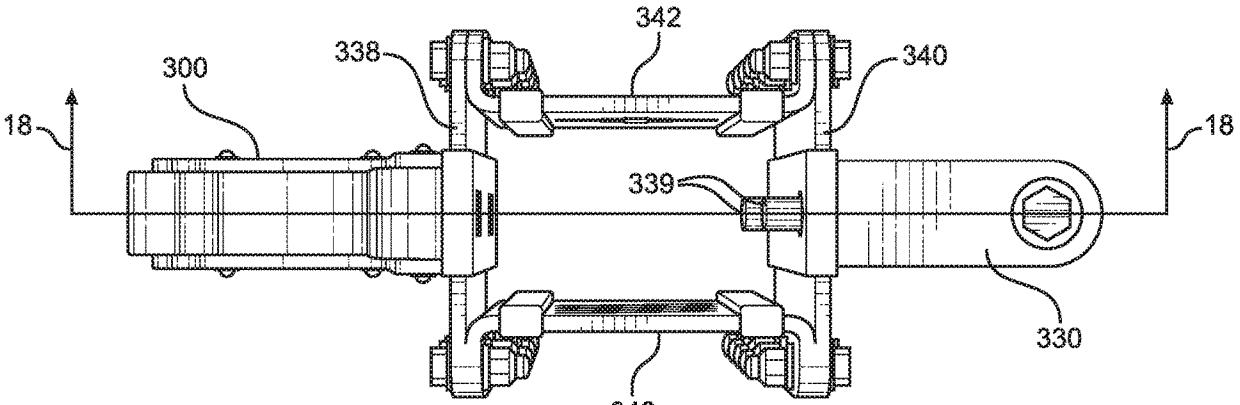
FIG. 17 is a top plan view of the apparatus of FIG. 14.
Figure 18:
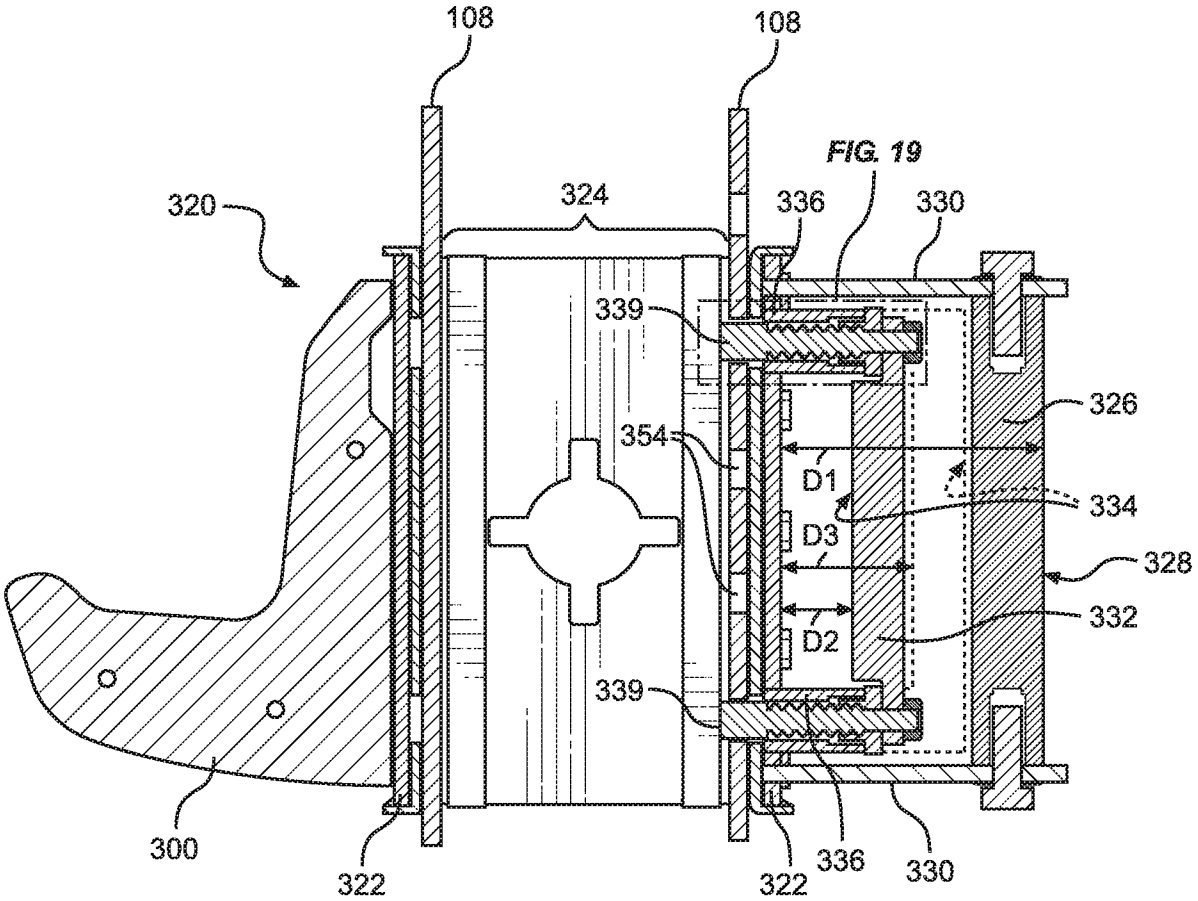
FIG. 18 is a sectional view of the apparatus of FIG. 17 shown along line "18-18"
Figure 19:
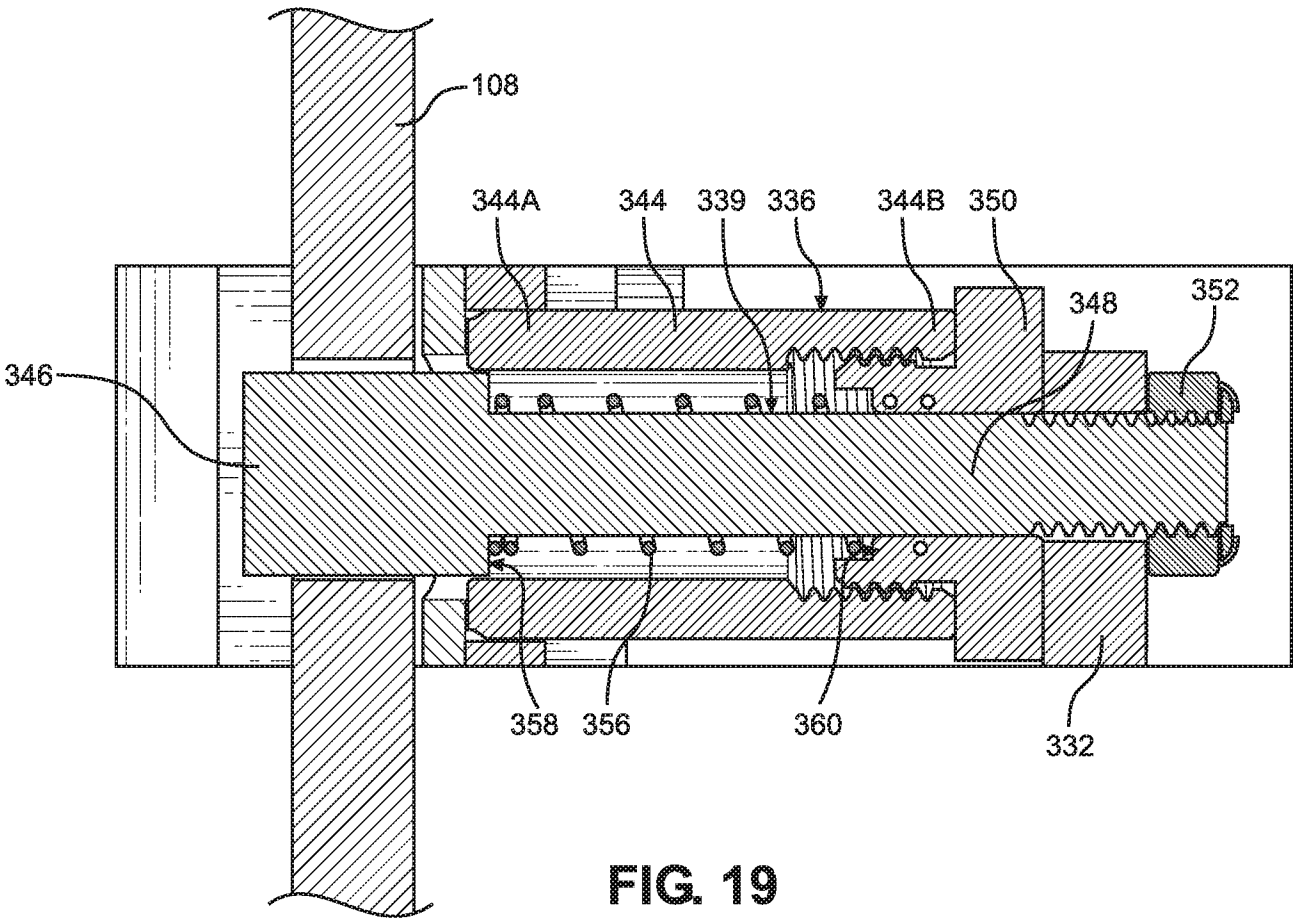
FIG. 19 is a detailed view of the portion of the apparatus shown in FIG. 18 marked "FIG. 19."

Referring now to FIGS. 17-19, the first spacers 330 fixedly mount the stationary handle 326 to the accessory carrier 322 so that the palm contact surface 328 is spaced a distance D1 away from the accessory carrier. The second spacers 336 allow the moving handle 332 to be moved between an engaged position and a disengaged position. The moving handle 332 is shown in the disengaged position in FIG. 18 by dashed lines. When the moving handle 322 is in the engaged position, the finger contact surface 334 is spaced a distance D2 away from the accessory carrier 322, where distance D2 is less than distance D1. To move the moving handle 332 to the disengaged position, it is moved away from the accessory carrier 332 (to the right, as shown in FIG. 18). In the disengaged position, the finger contact surface is spaced a distance D3 away from the accessory carrier 322, where distance D3 is less than distance D1 but greater than distance D2.

The exercise rack accessory apparatus 320 also includes a lock 339 and, more preferably, a pair of locks 339. The locks 339 are designed to be engaged and disengaged in response to movement of the moving handle 332. When the moving handle 332 is in the engaged position, the locks 339 engage a portion of the exercise rack that is located in the guide channel 324 and, through that engagement, prevent relative movement of the accessory carrier 322 with respect to the exercise rack. When the moving handle 332 is in the disengaged position, the locks 339 are disengaged from the exercise rack and movement of the accessory carrier 322 with respect to the exercise rack is permitted.

In the illustrated embodiment, the locks 339 are formed as part of the second spacers 336. The second spacers 336 include a barrel 344 having an open end 344A and a closed end 344B, and an opening is formed in the closed end of the barrel. In this particular case, a threaded cap 350 having an opening formed in it is threaded into a threaded end of the barrel 344 to close the end of the barrel. Each lock 339 includes a pin end 346 that is mounted to an end of a shaft 348. In the illustrated case, the shaft 348 of the lock 339 extends through the barrel 348 and then out of the barrel via the opening formed in the cap 350. The shaft 348 then extends through another opening that is formed at an end of the moving handle 332. A nut 352 is then threaded onto a threaded end of the shaft 348 and tightened against the moving handle 332 to removably mount the moving handle to the second spacer 336.

In the illustrated embodiment, the open end 344A of the barrel 344 opens into the guide channel 324. When the moving handle is moved from the disengaged position to the engaged position, the lock 339 slides through the barrel 344 and the pin end 346 extends out of the open end 344A and into the guide channel 324. When the moving handle 332 is in engaged position, the pin end 346 is inserted into one of several vertically-disposed openings 354 (or other similar structure) that are provided along vertical rack member 108. In this configuration, the accessory carrier 322 (and the accessory 300) are locked at the selected vertical position on the exercise rack. Pulling back on the moving handle 332 towards the disengaged position causes the lock 339 to disengage from the exercise rack. When the locks 339 disengage from the exercise rack, the accessory carrier 322 (and the accessory 300) can slide vertically upwards or downwards along vertical rack members 108.

In preferred embodiments, the moving handle 332 is biased to the engaged position. This functions as a safety feature because biasing the moving handle 332 to the engaged position will cause the lock to automatically engage and stop moving if it were dropped. Therefore, certain embodiments include a spring 356 or its functional equivalent that biases the moving handle 332 towards the engaged position. In the illustrated embodiment, the spring 356 is located in the barrel 344 and surrounds the shaft 348 of the lock 339. In this particular case, one end of the spring 356 bears an internal shoulders 358 formed at the pin end 346 of the lock 339. The opposite end of the spring 356 bears against another internal shoulder 360 located inside the barrel 344. The spring 356 is compressed as the moving handle 332 is moved towards the disengaged position. Preferably, the spring 356 is always at least slightly compressed between shoulders 356 and 360, including when the moving handle 332 in the disengaged position and the engaged position. This ensures that the lock 339 is never loose.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations as would be appreciated by those having ordinary skill in the art to which the invention relates.

What is claimed is:

1. An exercise rack accessory apparatus adapted for use with an exercise rack, the exercise rack accessory apparatus comprising:

an accessory carrier configured to carry an exercise accessory and to slide along a portion of the exercise rack;

a lock having a pair of pins, the pair of pins each having a pin end configured to move between an engaged position and a disengaged position;

a stationary handle;

a palm contact surface formed on the stationary handle that is configured to be contacted by a user's palm;

a moving handle; and a finger contact surface formed on the moving handle that is configured to be contacted by the user's fingers when the user's palm is in contact with the palm contact surface for use in moving the moving handle, wherein, when the moving handle is moved to the engaged position, the lock moves to the engaged position and both of the pin ends engage the exercise rack to prevent the accessory carrier from sliding along the exercise rack, and wherein, when the moving handle is moved to the disengaged position, the lock moves to the disengaged position and both of the pin ends are disengaged from the exercise rack and the accessory carrier is permitted to slide along the exercise rack.

2. The apparatus of claim 1 further comprising:

a pair of first spacers fixedly mounting the stationary handle to the accessory carrier;

a pair of second spacers mounting the moving handle to the accessory carrier between the stationary handle and the accessory carrier and configured to allow the moving handle to be moved between an engaged position and a disengaged position, each of the pair of second spacers having a barrel having an open end and a closed end with an opening formed therein, the pair of pins each extends through the respective barrels of the pair of second spacers, wherein an end of each of the pair of pins that is located opposite the pin ends extends out of the respective closed ends of the barrels via the opening and is mounted to the moving handle, the pin end of each of the pair of pins is configured to slide into the respective barrel via the open end, when the moving handle is moved to the disengaged position, and out of the respective barrel via the open end to engage the exercise rack, when the moving handle is moved to the engaged position.

3. The apparatus of claim 2 further comprising a spring that is located in each of the barrels of the pair of second spacers and that surrounds the pin extending through the barrel, each of the springs is compressed between the pin end of the respective pin and the closed end of the respective barrel when the moving handle is moved to the disengaged position, and biases the moving handle to the engaged position when the moving handle is released.

4. The apparatus of claim 3 wherein each of the springs bears against internal shoulders located within the respective barrel that are formed on each of the respective barrel and the pin.

5. The apparatus of claim 3 wherein the spring is at least partially compressed when the moving handle is in the engaged position and also when the moving handle is in the disengaged position.

6. The apparatus of claim 2 wherein, in the engaged position, the pin end of each pin of the pair of pins extends through a portion of the accessory carrier in order to engage the exercise rack.

7. The apparatus of claim 2 wherein a removable cap closes said closed end of each of the barrels and each of said openings is formed in the removable cap, wherein, for each of the barrels, removing the removable cap enables the pin located in the barrel to be removed from the barrel.

8. The apparatus of claim 2 wherein the moving handle is provided with a pair of openings, a threaded end of each of the pair of pins extends through one of the openings of the moving handle and a nut is configured to thread onto the threaded end of each of the pair of pins such that the moving handle is sandwiched between the nuts and the pair of second spacers.

9. The apparatus of claim 1 wherein:

the accessory carrier includes a front plate, a rear plate, and a pair of side plates connected between the front plate and the rear plate;

an accessory mounting location is disposed on an outer surface of the front plate or a side plate;

the stationary handle is mounted to the back plate; and the moving handle is mounted to the back plate.

10. The apparatus of claim 1 further comprising:

a pair of first spacers fixedly mounting opposite ends of the stationary handle to the accessory carrier;

a pair of second spacers mounting opposite ends of the moving handle to the accessory carrier, wherein the moving handle is parallel with the stationary handle and the moving handle and the pair of second spacers are enclosed on three sides by the pair of first spacers and the stationary handle.

11. The apparatus of claim 1 further comprising the exercise accessory mounted to the accessory carrier.

12. The apparatus of claim 1 wherein:

the palm contact surface is spaced a distance D1 away from the accessory carrier, when the moving handle is in the engaged position, the finger contact surface is spaced a distance D2 away from the accessory carrier, where distance D2 is less than distance D1, and wherein, when the moving handle is in the disengaged position, the finger contact surface is spaced a distance D3 away from the accessory carrier, where distance D3 is less than distance D1 but greater than distance D2.

13. The apparatus of claim 1 wherein the palm contact surface is angled 180° with respect to the finger contact surface.

14. The apparatus of claim 1 wherein the moving handle is biased to the engaged position.

15. The apparatus of claim 1 wherein:

the stationary handle is oriented such that the user's palm contacts the palm contact surface along a first axis;

the moving handle is oriented such that the user's fingers contact the finger contact surface along a second axis; and the accessory carrier is oriented such that the exercise accessory slides along a portion of the exercise rack along a third axis, wherein the first axis, second axis, and third axis are parallel and aligned with one another.

16. An exercise rack accessory apparatus adapted for use with an exercise rack, the apparatus comprising:

an accessory carrier configured to carry an exercise accessory, to slide along a portion of the exercise rack, and to be fixed at a desired location;

a pair of handles, including a stationary handle and a moving handle that moves between an engaged position and a disengaged position, mounted to the accessory carrier that are configured to be grasped simultaneously by a single hand of a user, where a palm of the user's hand contacts the stationary handle and fingers of the user's hand contacts and moves the moving handle, wherein the moving handle is configured to move to the disengaged positioned when the user's hand is squeezed;

a pair of pins that are movable with the moving handle and that are configured to automatically engage the exercise rack to prevent the accessory carrier from moving with respect to the exercise rack when the moving handle is in the engaged positioned and to disengage from the exercise rack to allow the accessory carrier to slide along the exercise rack when the moving handle is in disengaged position.

17. The apparatus of claim 16 wherein:

the stationary handle is oriented such that the user's palm contacts stationary handle along a first axis;

the moving handle is oriented such that the user's fingers contact the moving handle along a second axis; and the accessory carrier is oriented such that the exercise accessory slides along a portion of the exercise rack along a third axis, wherein the first axis, second axis, and third axis are parallel and aligned with one another.

* * * * *